United States Patent [19]

Laine

[11] 4,304,405

[45] Dec. 8, 1981

[54] FRICTION ADAPTOR FOR COMPETITIVE GAMES

[76] Inventor: Klas I. Laine, 21600 Parainen Simonby, Finland

[21] Appl. No.: 93,651

[22] Filed: Nov. 13, 1979

[30] Foreign Application Priority Data

Dec. 5, 1978 [FI] Finland ..... 783737

[51] Int. Cl.[3] ..... A63F 7/06

[52] U.S. Cl. ..... 273/85 B

[58] Field of Search ..... 273/85 A, 85 B, 85 F, 273/129 V

[56] References Cited

FOREIGN PATENT DOCUMENTS

| | | | |
|---|---|---|---|
| 1386454 | 12/1964 | France | 273/85 F |
| 503521 | 12/1954 | Italy | 273/85 A |
| 303956 | 9/1968 | Sweden | 273/85 A |
| 2862 | of 1903 | United Kingdom | 273/85 F |

*Primary Examiner*—Paul E. Shapiro

*Attorney, Agent, or Firm*—Nolte and Nolte

[57] ABSTRACT

The invention covers a friction adaptor enabling a simulated player in a table game such as soccer or hockey to strike a ball or the like independently with one foot or extension member, and to make a full turn on the other foot or member.

7 Claims, 3 Drawing Figures

FRICTION ADAPTOR FOR COMPETITIVE GAMES

BACKGROUND OF THE INVENTION

This invention is concerned with table games simulating soccer or hockey or the like preferably comprising a playing field board over which simulated game players move and propel a ball or puck or similar object. Bodily movement of the players is individually controlled by linearly movable and rotatable rods underneath the board and communicating with the players through slots in the board.

The invention is particularly concerned with means for enabling the simulated players to both independently strike the ball or other object used in the game and to turn, in addition to moving backward and forward upon the playing field.

DESCRIPTION OF THE PRIOR ART

In known football games in which the persons playing the game sit in chairs and propel an object resembling a football into the opponent's goal by means of mechanical devices, there is the disadvantage that the game is far removed from a true game event inasmuch as the simulated players each consist of a rigid object which moves only forwards or backwards in its slot, or only revolves.

BRIEF SUMMARY OF THE INVENTION

It is characteristic of the simulated player introduced herein that the right foot of the simulated player performs a specific kicking motion, while the simulated player can make a full turn (380 degrees) and can also be moved forwards and backwards. The controlling of the foot through the field is effected by means of turning knobs located at the ends of the board, of which there is one knob for each simulated player.

It is characteristic of the design of the present simulated player that it is assembled from plastic components and finished by conventional methods, as is the friction adaptor itself with its footing.

The invention contemplates a friction adaptor for table games simulating soccer, hockey or the like and preferably comprises a playing field surface of a rectangular board whereon, at play, a ball or puck or similar missile is propelled by teams of simulated players which can be moved along slots in the playing field board and which can also be rotated by means of linearly movable and rotatable operating rods which are each connected through a pair of conical gears to a pivot rigged through a connecting piece in the form of a shaft perpendicularly extending through the respective slot in the playing field board, above which, and affixed to the top of the shaft is a lever attached to the kicking foot of the simulated player. The other foot of the simulated player is affixed to a recess in the base while the leg connected to the lever is articulated with the body of the simulated player. As a separate part, a base is joined to the connecting piece through slots in the connecting piece, so that the connecting piece and the base constitute between themselves a friction adaptor.

An advantage of the invention described herein is that all the motions of the simulated player, by reason of the friction adaptor, can be controlled by turning a single knob. Thanks also to the friction adaptor the structure is moreover the simplest possible and is thus more economical than other known applications. On account of the simplicity of its construction, the invention is dependable.

DESCRIPTION OF THE PREFERRED EMBODIMENT

Figure 1:
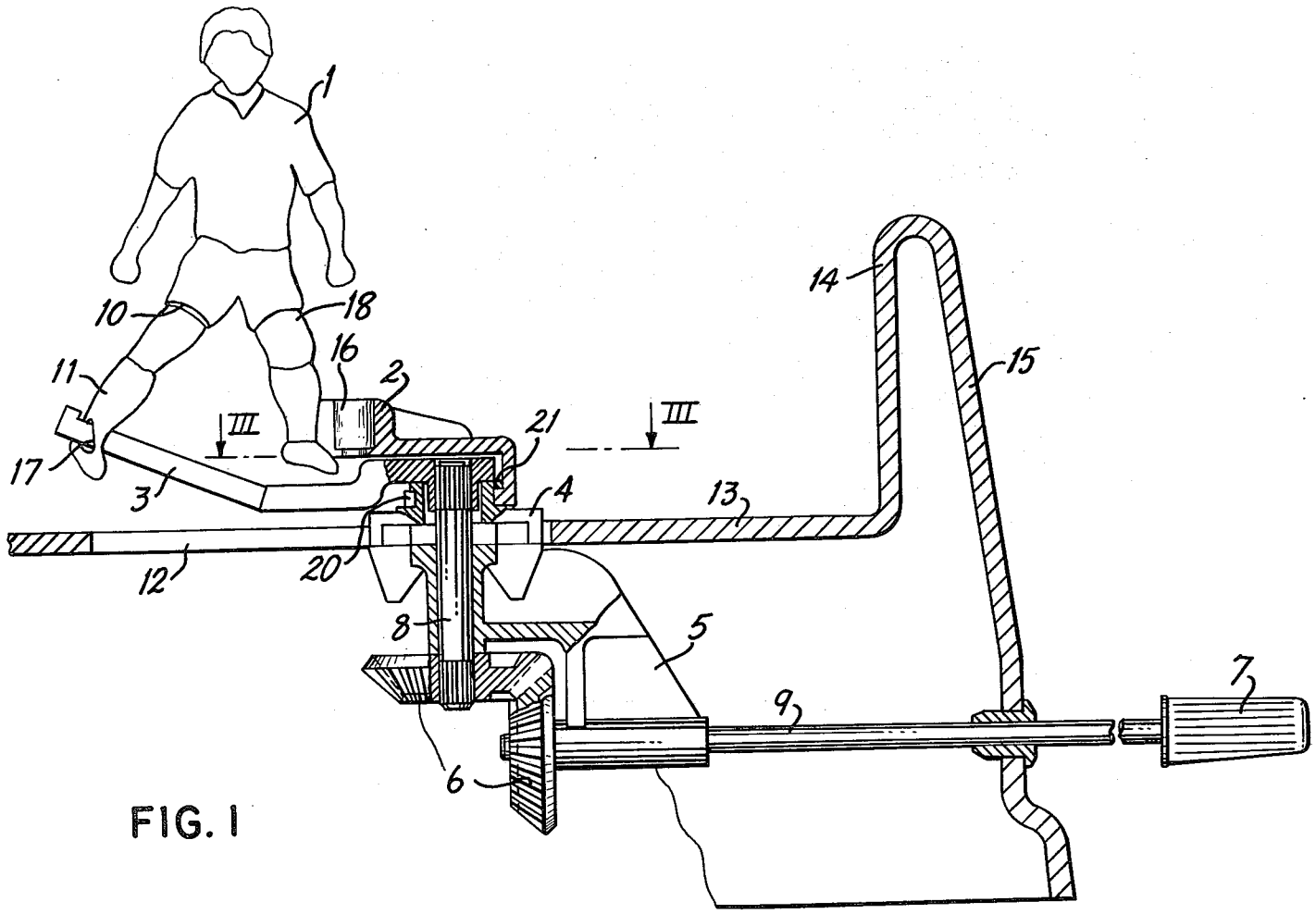
FIG. 1 shows in cross-section and from the side the construction of the simulated player including the footing and connecting piece, which together comprise the friction adaptor.
Figure 2:
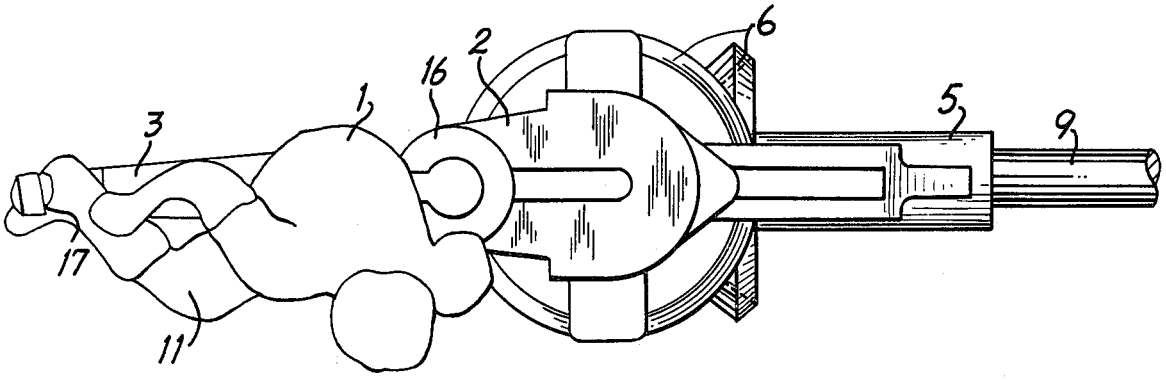
FIG. 2 shows the simulated player installed on the footing, as viewed from above.

In FIG. 1 the playing field board, which is preferably rectangular, bears the number 13. The playing field is surrounded by a rim 14 which gives the playing field its shape and corresponds to the field of the desired game. The rim 14 joins with the frame 15 which supports the playing surface 13.

The playing field board 13 is equipped, in the longitudinal direction at least, with slots 12 through which the shafts 8, vertically located, have been arranged to run. The shafts 8 are above the playing field board 13 and are designed for attachment to levers 3.

The operating levers 9 are mounted in bearings on the frame 15 and are equipped with knobs 7 at their ends which extend beyond the frame 15. The inner end of each operating rod 9 is attached underneath the playing field board 13 to a corner piece 5 which is movable by means of the rod 9.

Shaft 8 is mounted on bearings to the cornerpiece 5 and, as it is connected with the rod 9 through a pair of conical gears, it can be made to obey the turning of the operating rod 9.

Both the shaft 8 and the rod 9 are fastened to the cornerpiece 5 through bearings allowing rotary motion, and are otherwise fixed relative to the cornerpiece 5.

As best seen in FIG. 1, the left leg 18 of the simulated player 1 is fastened to the footing 2 via extension 16. The right leg 11 has a ball joint 10 and is bearing-mounted to lever 3 at point 17.

Figure 3:
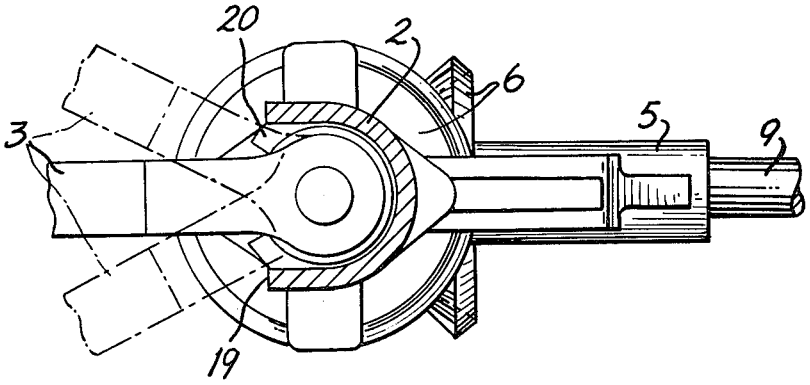
FIG. 3 shows the friction adaptor composed of the footing and connection piece, in cross-section and also as viewed from above.

As best seen in FIG. 3 the footing 2 is equipped with a friction arch 20 which is fixed to the lower part of the footing 2.

Circumscribing the upper part of connecting piece 4 is a groove 21 into which the friction arch 20 is pushed in the direction of lever 3 whereby the footing 2 is locked as by clamping to connecting piece 4 together with which comprises the friction adaptor.

At the farmost pivoted positions of the lever (FIG. 3), relative to the footing 2, the lever 3 touches the edges 19 of the arch 20 of the footing 2; while the lever 3 and the footing 2 are not in contact at intermediate points with the result that the footing 2 does not turn when lever 3 is moved until lever 3 is turned so as to be in the farmost positions into contact with either edge 19 of footing 2; and when lever 3 is turned farther in the same direction the footing 2 turns with lever 3 as does the simulated player 1 on footing 2.

In light of the foregoing, it will be appreciated that the present invention proposes a friction adaptor for table games which are intended to simulate hockey, soccer or the like and which preferably comprise a playing field consisting preferably of a rectangular board (13) on which during play with a puck, a ball or the like, this play object is propelled by means of a number of simulated players which are arranged so as to be moved by the persons playing the game along slots (12) in the playing field board (13) and to be rotated by means of operating rods (9) that are linearly movable and are also rotatable and are mounted underneath the board (13) wherein every operating rod (9) is connected by means of a pair of conical gears (6) to a shaft (8) arranged through a connecting piece (4) and disposed in a position primarily perpendicular to the playing field, and extending through the respective slot (12) in the playing field board (13) above which a lever (3) is attached to the upper part of the shaft (8), to which lever the kicking foot (17) of the simulated player (1) is affixed. The other leg (18) of the simulated player (1) is affixed to the extrusion (16) in the footing (2) while the leg (11) attached to the lever (3) is connected to the rest of the body of the simulated player (1). The footing (2) is joined as a separate part to the connecting piece (4) by a groove (21) in the connecting piece such that the connecting piece (4) and the footing (2) together constitute a friction adaptor characterized in that the footing (2) is equipped with a friction arch (20) that in turn is arranged so as to function in conjunction with a matching groove (21) in the connecting piece (4), whereby the footing (2) is locked to the connecting piece (4) constituting in combination the friction adaptor.

In the foremost or outermost pivoted positions of the lever 3 relative to the footing 2, the lever and footing are in contact with each other. In the intermediate positions of the lever, the lever and footing are not in contact; and consequently the lever may be moved freely between said foremost positions; and during such free movement the footing 2 will not turn when the operating rod 9 is rotated. But the footing 2 has an arch edge 19 which is touched or contacted by the lever 3 when the operating rod 9 is rotated sufficiently to move the lever 3 into either of is furthest or outermost positions as seen in phantom lines in FIG. 3. When that occurs, and if the lever 3 is moved even further in the same direction by continued rotation of the operating rod 9, the friction is overcome, and the footing 2 turns with the lever 3; and so does the simulated player 1 mounted on the footing 2.

What is claimed is:

1. The combination with a table game simulating soccer and hockey or the like, including a playing field, a plurality of game players adapted to be placed thereon in spaced relation with a moveable object, of means for enabling at least one of said players to kick the object from one place to another on said playing field with one foot, said means comprising gear means mounted below the level of the field for rotating in either direction a shaft projecting above the level of the playing field from said gear means, and lever means fixed at its inner end to said shaft above the level of the playing field and extending at its outer end to engage the kicking foot of said player, said means also comprising means connected to the player for turning that player bodily in either direction.

2. The combination of claim 1 further characterized in that the outer end of said lever extends eccentrically away from the level of said playing field.

3. An integrated assembly for a table game including a simulated biped for enabling said simulated biped to successively first swing one foot in the air and then completely revolve on the other foot while maintaining said first foot in the air comprising in combination an eccentrically disposed lever attached at its outer end to said one foot of said biped and fixed at its inner end to shaft means rotatable in at least one direction for first simultaneously moving the outer end of said lever and said first foot to which it is attached for swinging said first foot through an arc in the same direction, and friction means connected for coaction with the other foot of said biped and said rotatable shaft means for completely revolving said biped on said other foot upon further rotation of said shaft means in the same direction.

4. A friction adaptor assembly for competitive games enabling a kicking motion of a simulated player characterized in that the persons playing at opposite ends of a playing field endeavor manually by means of rotatable knobs to move one foot of a simulated player so as to kick a propellable object into the opponent's goal, comprising a rotatable knob connected to a lever attached to one foot of the player and to a footing attached to the player's other foot, and friction means connected to said knob and coacting with both said lever and said footing for permitting the player to kick the object with one foot without turning when said knob is initially rotated to a predetermined point and for frictionally holding the player against further rotation at said predetermined point and for enabling the same player to turn bodily on the other foot when said knob is rotated beyond said predetermined point to thereby overcome said friction means.

5. A friction adaptor assembly for competitive games enabling a swinging motion of one part of a simulated player unit characterized in that the persons playing at opposite ends of a playing field endeavor manually by means of rotatable knobs to move said one part of a simulated player unit so as to strike a propellable object toward the opponent's side of the playing field, comprising a rotatable knob connected to a lever attached to said one part of the player unit and to means rigidly attached to the player unit, and friction means connected to said knob and coacting with both said lever and said rigidly attached means for permitting the player to strike the object with said one part without movement of the whole player unit when said knob is initially rotated to a predetermined point and for frictionally holding the player unit against further movement at said predetermined point and for enabling the same player unit to move with said rigidly attached means when said knob is rotated beyond said predetermined point to thereby overcome said friction means.

6. A friction adapter assembly for games enabling a simulated player to kick, swivel, and move back and forth, comprising in combination: a rotatable member attached to one foot of the player and to means rigidly connected to the player's other foot, and friction means constructed and arranged to coact with said member and said rigidly connected means thereby enabling the player to kick without turning when said member is initially rotated in either direction to a predetermined point to actuate said friction means, and for enabling the same player to turn bodily in either direction with said rigidly connected means when said member is subsequently rotated beyond said predetermined point to thereby overcome said friction means.

7. A friction adaptor assembly for competitive games enabling a swinging motion of an appendage of a simulated player characterized in that the persons playing at opposite ends of a playing field endeavor manually by means of rotatable knobs to move one appendage of a simulated player so as to strike a propellable object toward the opponent's side of the playing field, comprising a rotatable knob connected to a lever attached to one appendage of the player and to means rigidly attached to the player, and friction means connected to said knob and coacting with both said lever and said rigidly attached means for permitting the player to strike the object with one appendage without turning when said knob is initially rotated to a predetermined point and for frictionally holding the player against further rotation at said predetermined point and for enabling the same player to turn bodily with said rigidly attached means when said knob is rotated beyond said predetermined point to thereby overcome said friction means.

* * * * *